US005502352A

United States Patent [19]

Katoh et al.

[11] Patent Number: 5,502,352

[45] Date of Patent: Mar. 26, 1996

[54] SPARK PLUG HAVING HORIZONTAL DISCHARGE

[75] Inventors: Akio Katoh, Nishio; Kozo Takamura, Nagoya, both of Japan

[73] Assignee: Nippondenso Co., Ltd., Kariya, Japan

[21] Appl. No.: 291,544

[22] Filed: Aug. 16, 1994

[30] Foreign Application Priority Data

Aug. 19, 1993 [JP] Japan ..... 5-205108

[51] Int. Cl.[6] ..... H01T 13/20

[52] U.S. Cl. ..... 313/141; 313/142; 123/169 EL

[58] Field of Search ..... 313/136, 139, 313/141, 142; 123/169 EL

[56] References Cited

U.S. PATENT DOCUMENTS 4,514,657 4/1995 Igashira et al. ..... 313/141

FOREIGN PATENT DOCUMENTS 51-66946 6/1976 Japan .
5715739 2/1977 Japan .
49-38866 9/1992 Japan .
5114455 5/1993 Japan .
5114454 5/1993 Japan .
5129063 5/1993 Japan .
5242953 9/1993 Japan .
5326107 12/1993 Japan .

*Primary Examiner*—Donald J. Yusko
*Assistant Examiner*—Nimesh Patel
*Attorney, Agent, or Firm*—Cushman, Darby & Cushman

[57] ABSTRACT

According to the present invention, a spark plug for an internal combustion engine includes a center electrode, a ground electrode so as to form a spark gap with the center electrode, and a tip electrode composed of a material having a superior consumable resistance as compared to the center electrode and disposed on an end face of the center electrode so as to form a spark gap with the ground electrode. An axial length of the discharge portion of the ground electrode where spark discharge occurs is substantially larger than an axial length of the tip electrode where spark discharge occurs. When used for an internal combustion engine, a spark discharge is mainly generated between the peripheral surface of the center electrode and the ground electrode during early operation. Consequently, as the center electrode has been consumed, the spark discharge is mainly generated between the tip electrode and the ground electrode. Therefore, the frequency of the spark discharge with the center electrode is lowered, and a low required voltage is maintained.

12 Claims, 6 Drawing Sheets

SPARK PLUG HAVING HORIZONTAL DISCHARGE

BACKGROUND OF THE INVENTION

1. Field of the Invention

The present invention relates to a spark plug for an internal combustion engine.

2. Description of the Related Art

Conventionally, in a spark plug used for an internal combustion engine, especially for a reciprocating engine, a required voltage for generating a spark in a gap between a center electrode and a ground electrode opposed to the center electrode (hereinafter referred to as "required voltage") has become extremely high because of the recent trend for a lower fuel consumption. Therefore, insulation break is sometimes caused in ignition systems. It has been desired to discover technique for generating a spark having a low required voltage.

Inventions for providing the above technique are disclosed in Japanese Patent Publication No. 52-15739 and Japanese Patent Laid-open publication No. 51-66946.

In the spark plug disclosed in Japanese Patent Publication No. 52-15739, a first spark gap between a first ground electrode opposing an end face of a center electrode and the center electrode and a second spark gap between a second ground electrode disposed at approximately a right angle with the first ground electrode around the center electrode and outer peripheral surface of the center electrode are formed. However, the spark plug of the above invention has a problem that, when used for an internal combustion engine, the spark gap is increased by large consumption by the center electrode, and so the required voltage rises.

On the other hand, the spark plug, disclosed in Japanese Patent Laid-open Publication No. 51-66946, in which a spark gap is formed between a center electrode and a ground electrode opposing the center electrode, is provided with a groove extending to the end of the center electrode in an axial direction of the center electrode on the side surface of the center electrode forming the spark gap. However, this spark plug also has a problem that, when used for an internal combustion engine, the spark gap is increased by large consumption by the center electrode, and so the required voltage rises.

SUMMARY OF THE INVENTION

In view of the above problems, it is an object of the present invention to provide a spark plug which can keep the required voltage low even when used for an internal combustion engine.

According to the present invention, a spark plug for an internal combustion engine comprises a center electrode having an outer peripheral surface and an end face, a ground electrode having a discharge portion opposed to the outer peripheral surface so as to form a spark gap therebetween, and a tip electrode composed of a material having a superior consumable resistance as compared to the center electrode, having a substantial identical cross-sectional shape to that of the end face, and disposed on the end face so as to form a spark gap with the discharge portion, wherein an axial length of the discharge portion of the ground electrode where spark discharge occurs is substantially larger than an axial length of the tip electrode where spark discharge occurs. When used for an internal combustion engine, a spark discharge is mainly generated between the peripheral surface of the center electrode and the discharge portion of the ground electrode during early operation. Consequently, as the center electrode has been consumed, the spark discharge is mainly generated between the tip electrode and the discharge portion of the ground electrode. Therefore, the frequency of the spark discharge with the center electrode is lowered, and a low required voltage is maintained. It is preferable that a second ground electrode is provided having a second discharge portion opposed to an end face of the tip electrode so as to form a second spark gap therebetween.

BRIEF DESCRIPTION OF THE DRAWINGS

Other objects, features, and advantages of the present invention will become apparent from a study of the following detailed description with reference to the appended claims and drawings.

In the accompanying drawings.

DETAILED DESCRIPTION OF THE PREFERRED EMBODIMENTS

Figure 1:
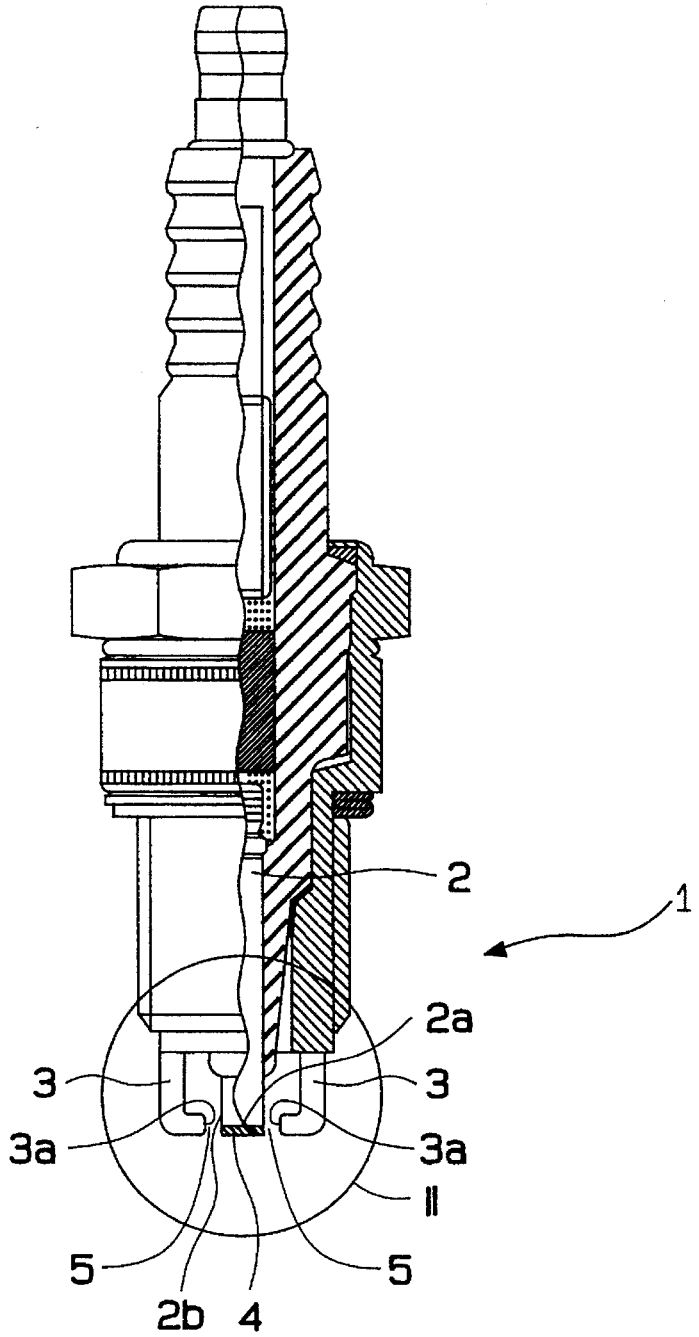
FIG. 1 is a partial cross sectional view showing first embodiment of the present invention.
Figure 2A:
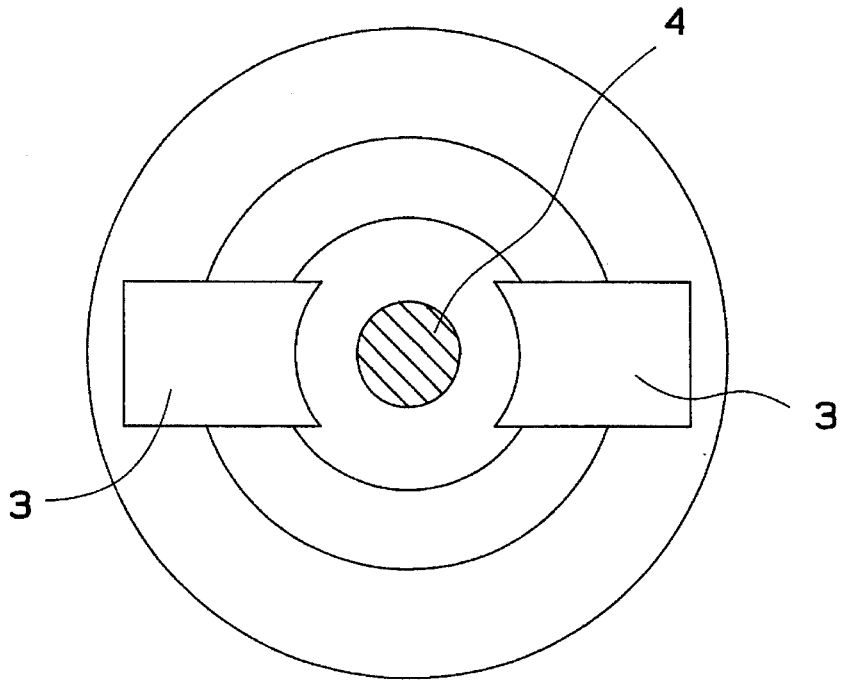
FIGS. 2A and 2B are enlarged views of portion II in FIG. 1, FIG. 2A being a bottom view and FIG. 2B being a side view.
Figure 2B:
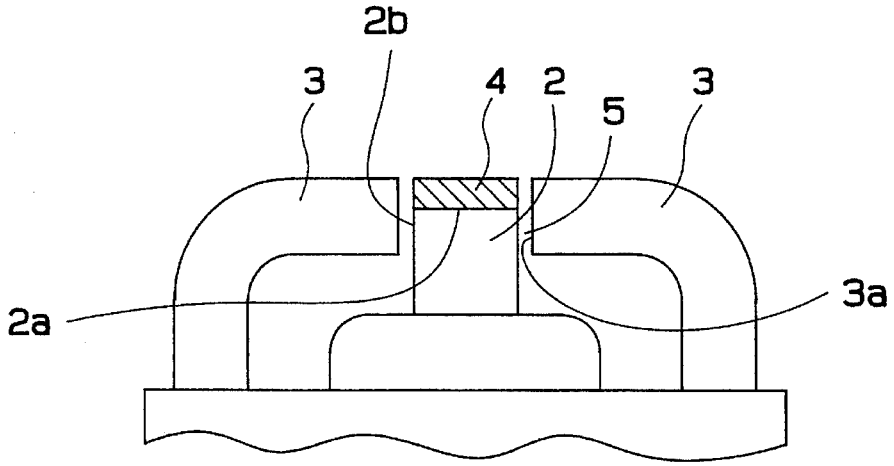

FIG. 1 shows a first embodiment of the present invention, and FIGS. 2A and 2B shows enlarged portion II of FIG. 1.

Spark plug 1 has a center electrode 2 composed of Nickel group heat resistance alloy such as (INCONEL 600) and a ground electrode 3 provided with a discharge portion 3*a* opposed to the outer peripheral surface 2*b* of the center electrode 2. A tip electrode 4 composed of a platinum alloy, for example (pt-20 wt % Ir), or other noble metal or noble metal alloy, and formed in a plate shape which is of identical size to the tip portion of the center electrode 2 is connected to the center electrode by soldering. A spark gap 5 of approximately 1.1 mm corresponds to the distance between the discharge portion 3*a* of the ground electrode 3 and outer peripheral surface of the center electrode 2. The spark gap 5 is formed between ground electrode 3 and center electrode 2. The spark plug 1 is manufactured such that the thickness of the tip electrode is in the range of from 0.1 mm to 1.2 mm and the thickness of the discharge portion 3*a* of the ground electrode 3 is in the range of from 0.4 mm to 1.6 mm. The spark plug prepared as described above was used for a vehicle engine, and the required voltage was measured after the engine had run for 50,000 km. The result is shown in FIGS. 4 and 5.

The description is made with reference to FIGS. 4 and 5 as below.

Figure 4:
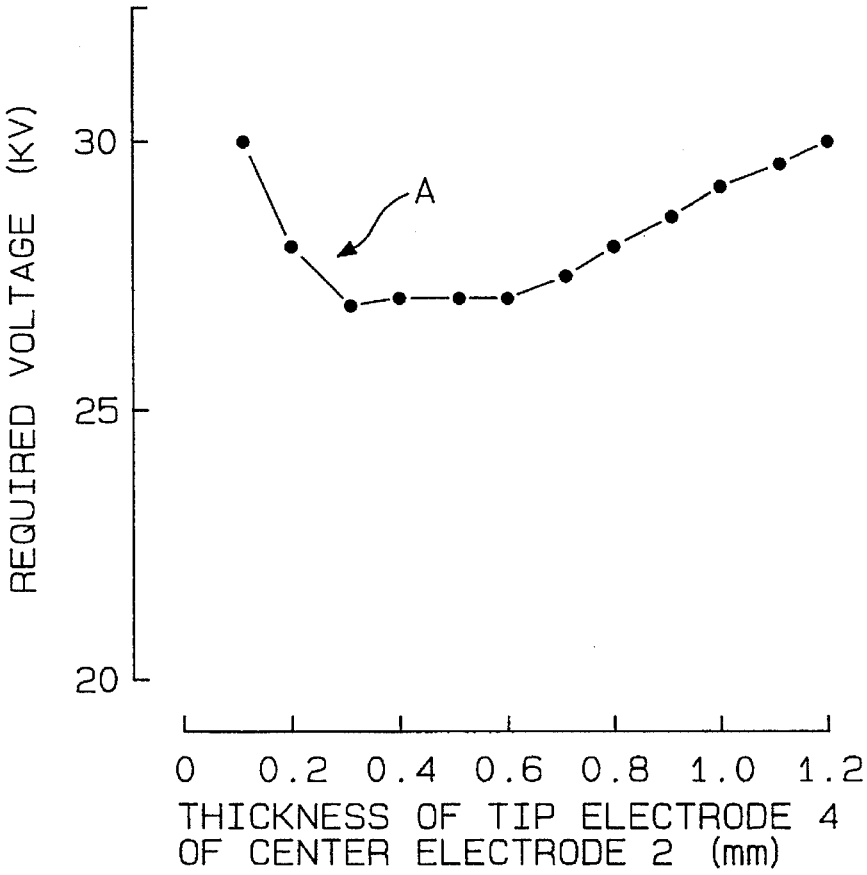
FIG. 4 shows the relationship between the thickness of the tip electrode 4 and the required voltage after the engine in which the first embodiment is installed has run for 50,000 km.
Figure 5:
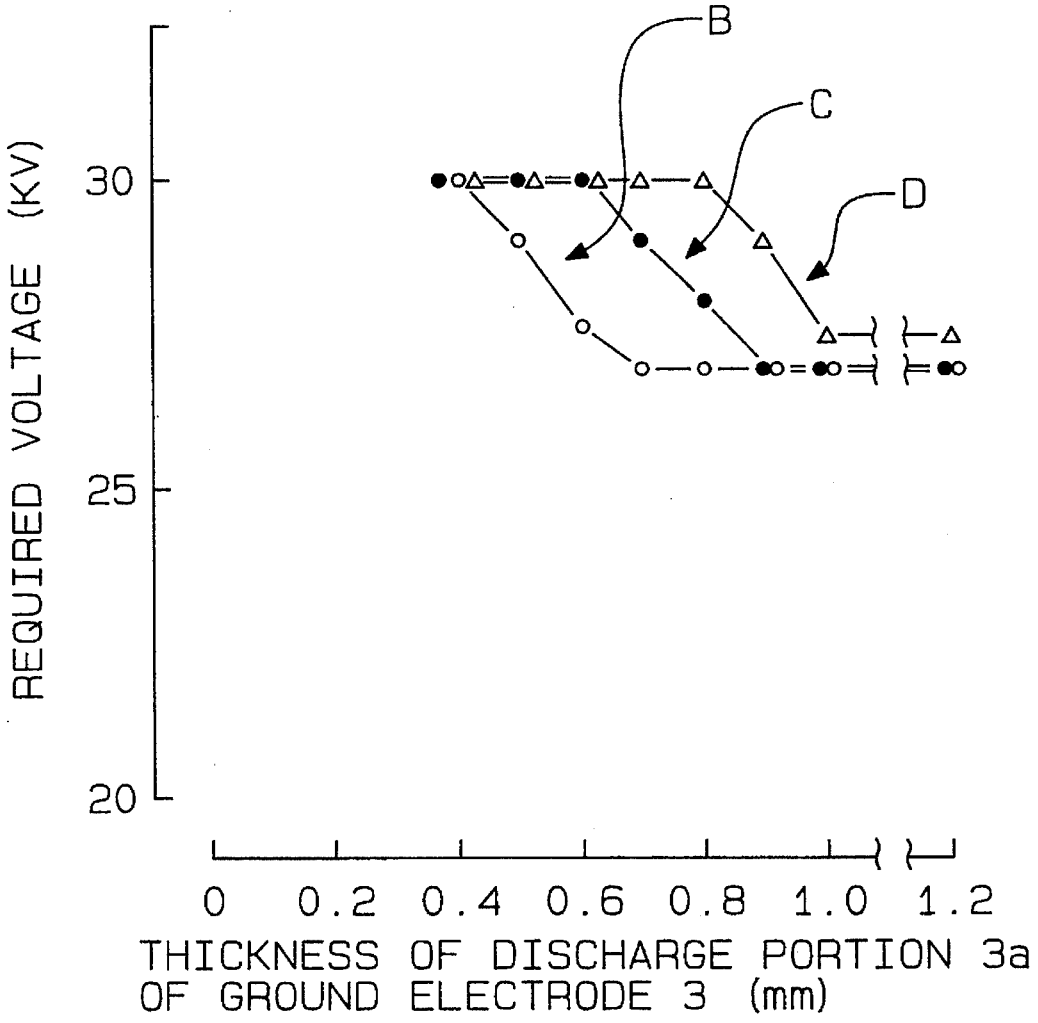
FIG. 5 is a graph showing the required voltage as a function of the thickness of the discharge portion 3*a* of the ground electrode 3 for the first embodiment.

FIG. 4 shows the relationship between the thickness of the tip electrode 4 and the required voltage after 50,000 km of the engine running. As the required voltage varies depending on the operating condition, the condition is fixed on the engine speed of 1,000 rpm with full load and the required voltage value is taken as the maximum value among one thousand times of discharge.

In FIG. 4, "A" shows the case in which the thickness of the discharge portion of the ground electrode is 1.4 mm. As the required voltage of the prior art is 30 to 31 KV, the thickness of the tip electrode should be no less than 0.2 mm and not more than 1.0 mm.

FIG. 5 is a graph showing a required voltage to the thickness of the discharge portion 3*a* of the ground electrode 3 as the parameter of the thickness of tip electrode 4 of the center electrode 2. In FIG. 5, "B", "C" and "D" correspond to the following cases of the thickness of the tip electrode 4: 0.3 mm, 0.5 mm and 0.7 mm, respectively. From FIG. 5, it is preferable that, the thickness of the discharge portion 3*a* should be not less than 0.5 mm, 0.7 mm and 0.9 mm corresponding to B, C, and D, respectively. That is to say, it is preferable that, the thickness of the discharge portion 3*a* should be larger by at least 0.2 mm than the thickness of tip electrode 4.

Figure 3:
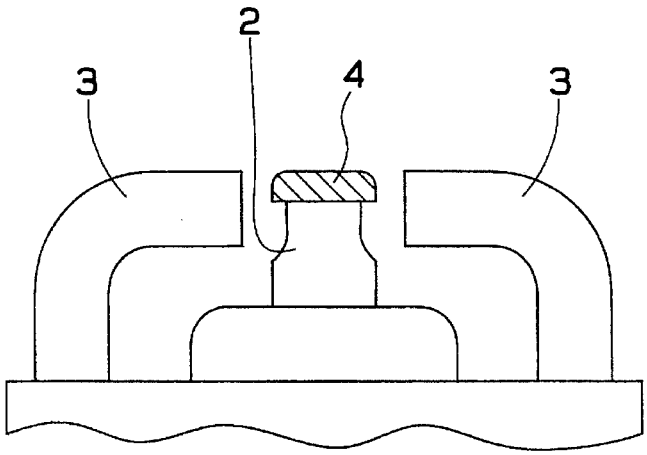
FIG. 3 shows a structure of the first embodiment used for engine, which has run for 50,000 km.

When the above spark plug is used for an internal combustion engine, a spark discharge for igniting is generated between the center electrode 2 and the ground electrode 3. As the consumable resistance of the tip electrode 4 is superior to that of the center electrode 2, these electrodes 2 and 4 are consumed such that the diameter of the tip electrode 4 becomes larger than that of the center electrode 2, as shown in FIG. 3. This structure allows for the electric field intensity to be strengthened and low required voltage to be maintained.

Figure 6:
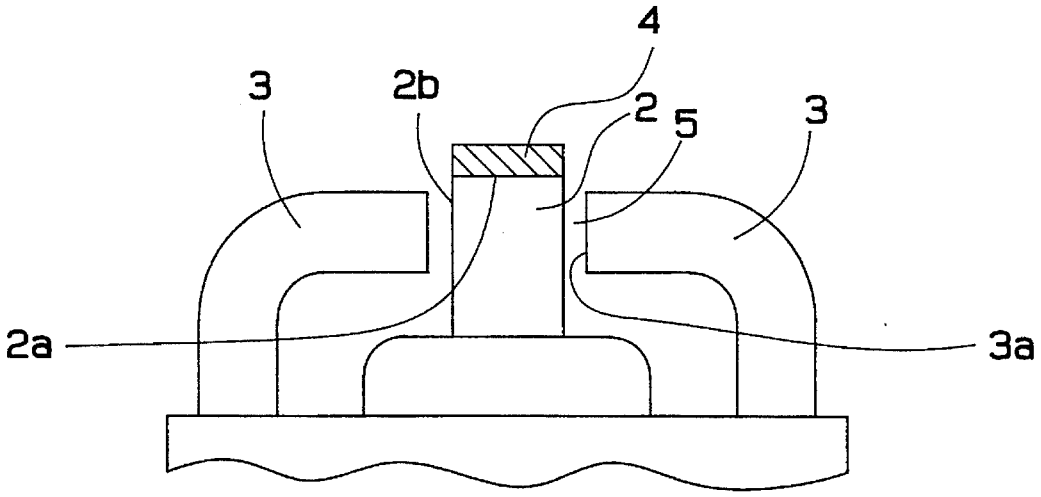
FIG. 6 is a modification of the first embodiment.

Although the axial end of the tip electrode 4 fits the end face of the center electrode 2 in this embodiment, it is also possible that the axial end of the tip electrode 4 protrudes from the end face of the ground electrode 3 as shown in FIG. 6.

Figure 7A:
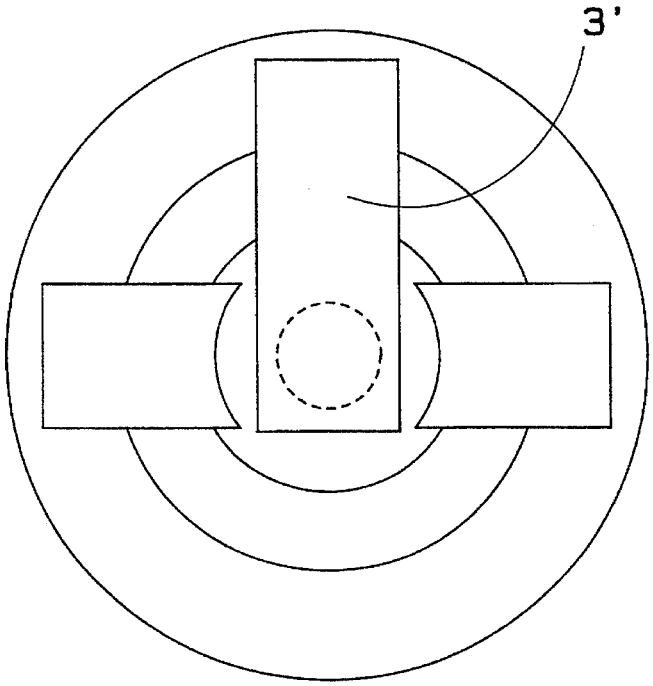
FIGS. 7A and 7B show a second embodiment of the present invention, FIG. 7A being a bottom view and FIG. 7B being a side view.
Figure 7B:
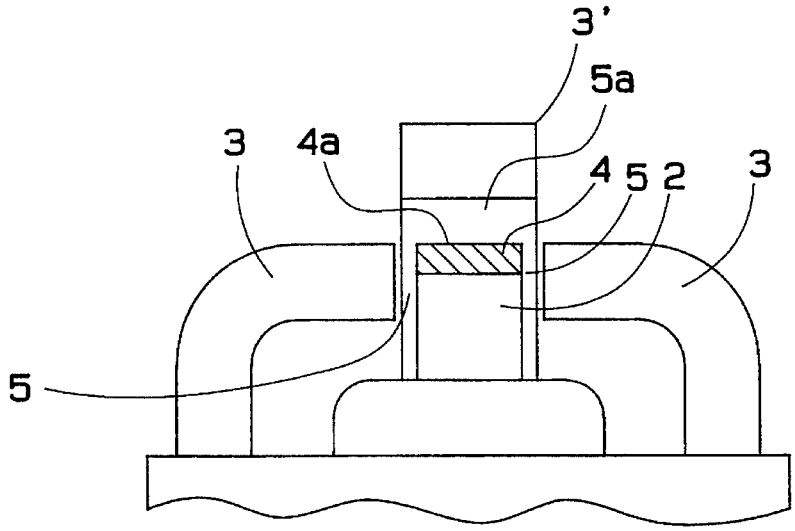

A second embodiment of the present invention is described with reference to FIG. 7. In the second embodiment, in addition to the structure of the first embodiment, another (third) ground electrode 3' is disposed so as to oppose the top end face 4*a*. The spark gap 5*a* is formed between the ground electrode 3' opposing the top end face 4*a* of the tip electrode 4 and the top end face 4*a*. The distance of the spark gap 5*a* is approximately 1.1 mm, which is identical to the distance of the spark gap 5 between the outer peripheral surface of the center electrode 2 and the discharge portion 3*a* of the ground electrode 3.

In the second embodiment, as the third ground electrode 3' is provided in addition to the first and second ground electrodes 3 facing each other, the consumption of the electrode is more suppressed. In addition, as the electrodes 2 and 4 are also consumed such that the diameter of the tip electrode 4 becomes larger than that of the center electrode 2, as shown in FIG. 3, the low required voltage is maintained.

Moreover, in addition to the structure of the first or second embodiment, providing the member composed of a consumable heat resistant material (e.g. Pt, Pt alloy, or other material), which is superior to the ground electrode 3, on the discharge portion 3*a*, the consumed amount is more suppressed. Therefore, the spark gaps 5 and 5*a* are better more stabilized, and the low required voltage is also maintained.

The present invention has been described in connection with what are presently considered to be the most practical and preferred embodiment. However, the present invention is not meant to be limited to those embodiments. Rather, the present invention is meant to include all modifications and alternative arrangements included within the spirit and scope of the appended claims.

What is claimed is:

1. A spark plug for an internal combustion engine comprising:

a center electrode having an outer peripheral surface and an end face;

a ground electrode having a discharge portion opposed to said outer peripheral surface so as to form a spark gap therebetween; and a tip electrode composed of a material having a superior consumable resistance as compared to said center electrode, having a cross-sectional shape substantially identical to that of said end face, and disposed on said end face so as to form a spark gap with said discharge portion;

wherein a thickness along an axial direction of said center electrode of said discharge portion of said ground electrode where spark discharge occurs is substantially larger than a thickness along said axial direction of said tip electrode where spark discharge occurs.

2. A spark plug according to claim 1, further comprising a connecting portion between said center electrode and said tip electrode;

wherein said discharge portion is opposed to said outer peripheral surface and faces said connecting portion.

3. A spark plug according to claim 1, wherein said discharge portion opposed to said outer peripheral surface faces only said center electrode.

4. A spark plug according to claim 1, wherein said cross-sectional shape is circular.

5. A spark plug according to claim 1, wherein said axial length of said tip electrode is in the range of from approximately 0.2 mm to approximately 1.0 mm and said axial length of said discharge portion of said ground electrode is at least 0.2 mm greater than said axial length of said tip electrode.

6. A spark plug according to claim 1, wherein said tip electrode is composed of noble metal or noble metal alloy.

7. A spark plug for an internal combustion engine comprising:

a center electrode having an outer peripheral surface and an end face;

a first ground electrode having a first discharge portion opposed to an outer peripheral surface of said center electrode so as to form a first spark gap therebetween;

a second ground electrode having a second discharge portion opposed to said end face of said tip electrode so as to form a second spark gap therebetween.

a tip electrode composed of a material having a superior consumable resistance as compared to said center electrode, having a cross-sectional shape substantially identical to that of said end face of said center electrode, and disposed on said end face so as to form a spark gap with said first discharge portion; and wherein a thickness along an axial direction of said center electrode of each said discharge portion of each said ground electrode where spark discharge occurs is substantially larger than a thickness along said axial direction of said tip electrode where spark discharge occurs.

8. A spark plug according to claim 7, further comprising a connecting portion between said center electrode and said tip electrode;

wherein said discharge portion opposed to said outer peripheral surface faces said connecting portion.

9. A spark plug according to claim 7, wherein said cross sectional shape is circular.

10. A spark plug according to claim 7, wherein said thickness of said tip electrode is in the range of from approximately 0.2 mm to approximately 1.0 mm and said thickness of said discharge portion of said ground electrode is at least 0.2 mm greater than said thickness of said tip electrode.

11. A spark plug according to claim 7, wherein said tip electrode is composed of noble metal or noble metal alloy.

12. A spark plug for an internal combustion engine comprising:

a center electrode having an outer peripheral surface and an end face;

a ground electrode having a discharge portion opposed to said outer peripheral surface so as to form a spark gap therebetween; and a tip electrode composed of a material having a superior consumable resistance as compared to said center electrode, having a cross-sectional shape substantially identical to that of said end face, and disposed on said end face so as to form a spark gap with said discharge portion;

wherein a thickness along an axial direction of said center electrode of said discharge portion of said ground electrode where spark discharge occurs is substantially larger than a thickness along said axial direction of said tip electrode where spark discharge occurs;

whereby a spark discharge is mainly generated between said peripheral surface of said center electrode and said discharge portion of said ground electrode during early operation and consequently is mainly generated between said tip electrode and said discharge portion of said ground electrode.

* * * * *